US007597539B1

(12) United States Patent
Liang

(10) Patent No.: US 7,597,539 B1
(45) Date of Patent: Oct. 6, 2009

(54) TURBINE BLADE WITH VORTEX COOLED END TIP RAIL

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 464 days.

(21) Appl. No.: 11/529,456

(22) Filed: Sep. 27, 2006

(51) Int. Cl.
*F01D 5/18* (2006.01)

(52) U.S. Cl. ..... 416/97 R

(58) Field of Classification Search ..... 415/115; 416/92, 97 R

See application file for complete search history.

(56) References Cited

U.S. PATENT DOCUMENTS

| | | | | |
|---|---|---|---|---|
| 3,635,585 | A | 1/1972 | Metzler, Jr. | |
| 3,934,322 | A | 1/1976 | Hauser et al. | |
| 4,606,701 | A * | 8/1986 | McClay et al. | 416/92 |
| 5,261,789 | A * | 11/1993 | Butts et al. | 416/96 R |
| 5,503,527 | A | 4/1996 | Lee et al. | |
| 5,511,946 | A | 4/1996 | Lee et al. | |
| 5,564,902 | A | 10/1996 | Tomita | |
| 5,733,102 | A | 3/1998 | Lee et al. | |
| 5,927,946 | A | 7/1999 | Lee | |
| 6,190,129 | B1 * | 2/2001 | Mayer et al. | 416/97 R |
| 6,527,514 | B2 * | 3/2003 | Roeloffs | 416/97 R |
| 6,616,406 | B2 | 9/2003 | Liang | |
| 6,652,235 | B1 | 11/2003 | Keith et al. | |
| 6,672,829 | B1 | 1/2004 | Cherry et al. | |
| 6,824,359 | B2 | 11/2004 | Chlus et al. | |
| 7,281,894 | B2 * | 10/2007 | Lee et al. | 416/92 |
| 7,473,073 | B1 * | 1/2009 | Liang | 415/173.5 |
| 2007/0258815 | A1 * | 11/2007 | Liang | 416/97 R |

* cited by examiner

*Primary Examiner*—Edward Look
*Assistant Examiner*—Ryan H Ellis
(74) *Attorney, Agent, or Firm*—John Ryznic

(57) ABSTRACT

A turbine blade having a squealer tip includes a trailing edge tip rail formed as an extension of the pressure side tip rail and the suction side tip rail. Positioned along the trailing edge tip rail is a pressure side vortex pocket and a suction side vortex pocket, and a plurality of angled cooling holes opening onto the tip cap adjacent to the vortex pockets, the holes being angled away from the vortex pockets. A row of film cooling holes on the pressure side wall and angled upward forces the hot gas flow up and over the blade pressure side edge and into a tip rail channel. Vortex flow is developed in both the vortex pockets, and with the addition of the angled cooling holes and pressure side wall cooling holes the trailing edge tip rail provides improved sealing and cooling for the blade tip.

8 Claims, 4 Drawing Sheets

TURBINE BLADE WITH VORTEX COOLED END TIP RAIL

CROSS-REFERENCE TO RELATED APPLICATIONS

This application is related to a pending U.S. patent application Ser. No. 11/453,432 filed on Jun. 14, 2006 by Liang and entitled TURBINE BLADE WITH COOLED TIP RAIL.

BACKGROUND OF THE INVENTION

1. Field of the Invention

The present invention relates generally to fluid reaction surfaces, and more specifically to a turbine airfoil with a squealer tip.

2. Description of the Related Art Including Information Disclosed Under 37 CFR 1.97 and 1.98

A gas turbine engine uses a compressor that produces a compressed air fed into a combustor and burned with a fuel to produce a hit gas flow. This hot gas flow is passed through a turbine which progressively reduces the temperature of the hot gas flow and converts the energy into mechanical work by driving the turbine shaft. Designers are continuously looking for ways to improve the engine performance. Raising the temperature of the hot gas flow will increase the efficiency of the engine. However, the temperature is limited to the material properties of the first stage vane and blade assembly. Designers have come up with complex cooling passages for cooling these critical parts in order to allow for the hot gas flow temperature to exceed the melting temperatures of these parts.

Another way to improve the performance of the engine is to reduce the leakage flow between the rotor blade tip and the outer shroud that forms a seal with the tip. Because the engine cycles through temperatures, the tip clearance varies. Sometimes, the tip touches against the shroud, causing rubbing to occur. Rubbing can damage the blade tips. Providing a larger tip clearance will reduce the chance of rubbing, but will also allow for more hot gas flow to leak across the gap and expose the blade cap to extreme high temperature. Cooling of the blade tip is required to limit thermal damage. Separate blade tip cooling passages have been proposed.

High temperature turbine blade tip section heat load is a function of the blade tip leakage flow. A high leakage flow will induce high heat load onto the blade tip section, and therefore blade tip section sealing and cooling have to be addressed as a single problem. The prior art have proposed a turbine blade tip to include a squealer tip rail which extends around the perimeter of the airfoil flush with the airfoil wall to form an inner squealer pocket. The main purpose of incorporating a squealer tip in a blade design is to reduce the blade tip leakage and also to provide the rubbing capability for the blade. FIG. 1 shows a typical prior art squealer tip cooling arrangement. The blade has a pressure side 12, a suction side 13, and a top 14 with a tip rail 15 extending along the top edge from the trailing edge around the leading edge before stopping short of the trailing edge on the pressure side 12. Film cooling holes 17 are built-in along the airfoil pressure side tip section from the leading edge to the trailing edge and provide edge cooling for the blade pressure side squealer tip. In addition, convective cooling holes 16 also built-in along the tip rail 15 at the inner portion of the squealer pocket 14 provide for additional cooling for the squealer tip rail 15. Secondary hot gas flow migration 21 around the blade tip section is also shown in FIG. 1. The secondary leakage flow 21 over the tip turns into a vortex flow 22 on the blade suction side 13.

FIG. 2 shows an enlarged view for the blade trailing edge squealer tip section. Since the blade tip rail 31 is cut-off at the aft section of the pressure side, it becomes a single squealer tip rail configuration and thus decreases the ability to reduce the blade tip leakage flow. Meanwhile, the suction side blade tip rail 32 is subjected to heating from three exposed sides. Cooling of the suction side squealer tip rail 32 by means of a row of discharge film cooling holes 34 along the blade pressure side peripheral and cooling holes 35 at the bottom of the squealer floor 36 becomes insufficient. Trailing edge cooling slots 33 provide trailing edge cooling. This is primary due to the combination of squealer pocket geometry and the interaction of hot gas secondary flow mixing The effectiveness induced by the pressure film cooling and tip section convective cooling holes is very limited.

It is therefore an object of the present invention to provide for cooling and sealing of an airfoil squealer tip along the trailing edge region of the blade.

BRIEF SUMMARY OF THE INVENTION

A squealer tip for a turbine blade trailing edge section that forms a seal with a BOAS, or blade outer air seal, between the blade tip and an outer shroud includes a tip rail with a pair of cooling air vortex pockets formed on the pressure side and the suction side of the tip rail. Blade tip cooling holes leading from the inner cooling channel supply cooling air to points just outside of the pockets and act to push the hot gas flow up and over the tip rail on the upstream side and up and over the suction side wall edge of the blade. Pressure side film cooling holes in the blade wall push the hot gas flow up and over the pressure side wall edge and into the tip rail space. The blade squealer tip rail configuration extends along the trailing edge region of the blade and provides both cooling and sealing to the tip.

DETAILED DESCRIPTION OF THE INVENTION

The blade tip leakage flow and cooling problem of the prior art can be alleviated by the sealing and cooling configuration of the present invention. A camber line tip rail construction with built-in vortex convective cooling pockets along the tip rail is used to resolve the sealing and cooling problems for a blade trailing edge tip section.

Figure 1:
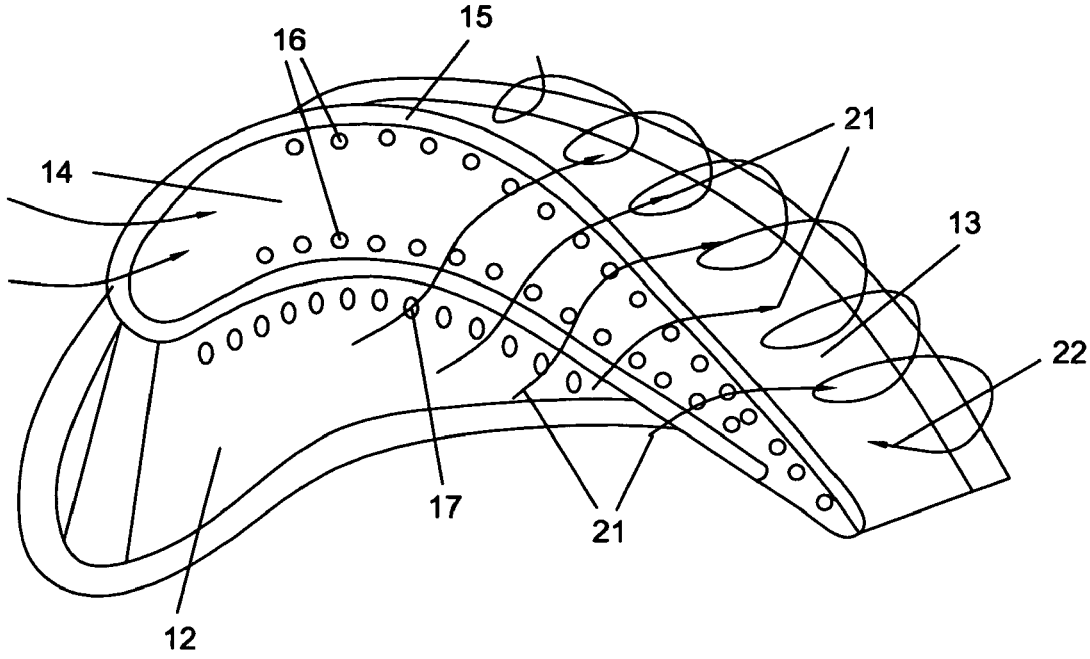
Fig 1 Prior Art
FIG. 1 shows a prior art blade tip with a secondary flow and cooling pattern over the tip.
Figure 2:
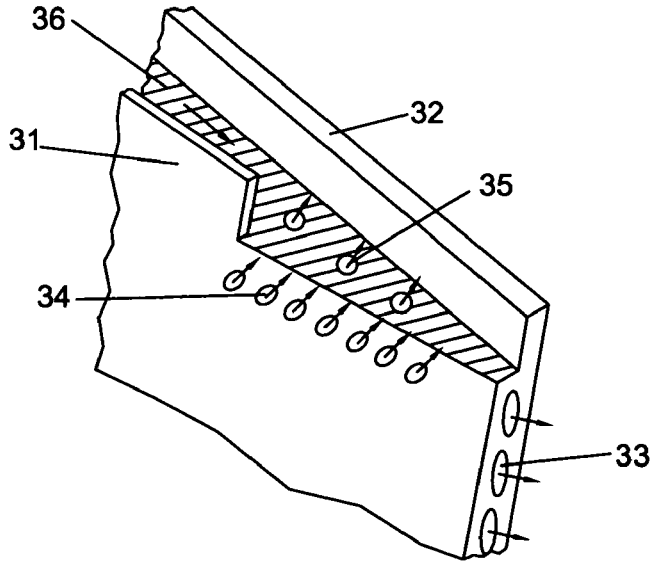
Fig 2 Prior Art
FIG. 2 shows a prior art blade with a squealer tip on the trailing edge.
Figure 3:
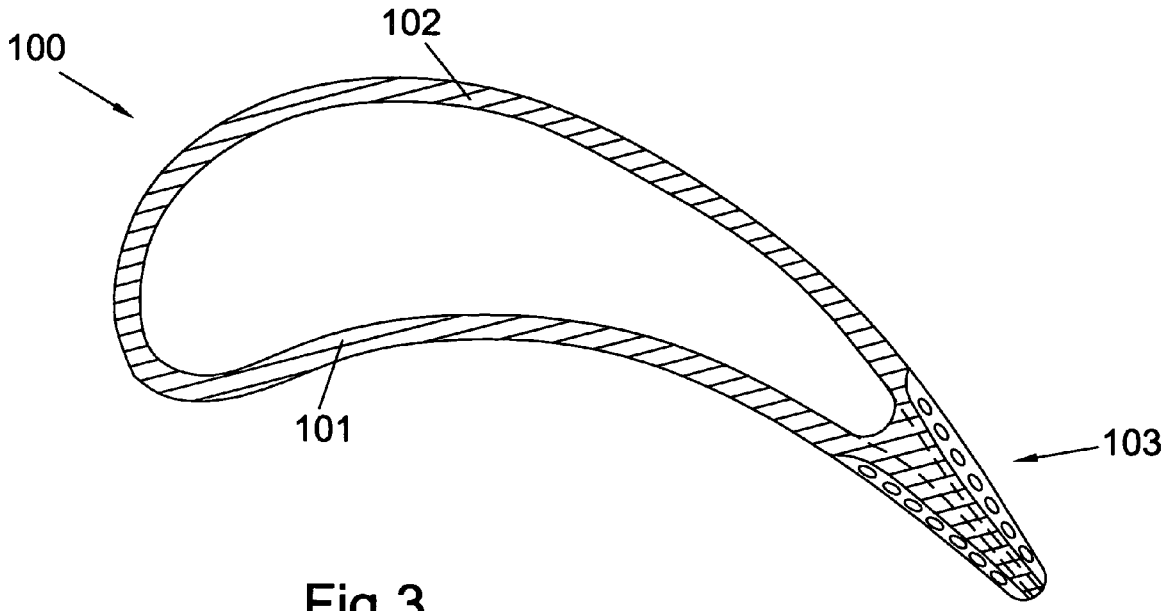
FIG. 3 shows a top view of a cross section of a blade of the present invention.

FIG. 3 shows a top view of a blade with the end tip sealing and cooling configuration of the present invention. The blade 100 includes a pressure side tip rail 101 and a suction side tip rail 102 extending along the blade walls on both sides. A squealer pocket 104 is formed by the tip rails 101 and 102. A centerline blade trailing edge end tip rail 103 is formed in the trailing edge region of the blade 100.

Figure 4:
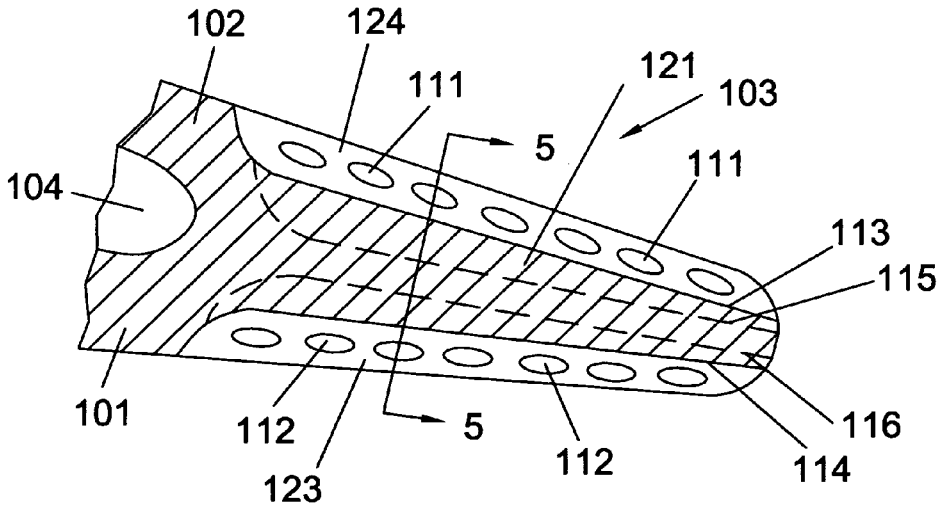
FIG. 4 shows a top view of the trailing edge region having the squealer tip of the present invention.

Details of the end tip rail 103 are shown in FIG. 4. The squealer tip pocket 104 is shown with portions of the pressure side tip rail 101 and suction side tip rail 102. At the rearward end of the pocket 104 the pressure side rail 101 and suction side rail 102 merge and extend along the centerline to the trailing edge, forming a trailing edge tip rail 121. The trailing edge tip rail has a pressure side surface 114 and a suction side surface 113. Tip cooling holes 112 open onto a top surface formed on the pressure side, and tip cooling holes 111 open onto a top surface formed on the suction side of the trailing edge region. Vortex pocket side wall 116 is formed on the pressure side, and a vortex pocket sidewall 115 is formed on the suction side.

Figure 5:
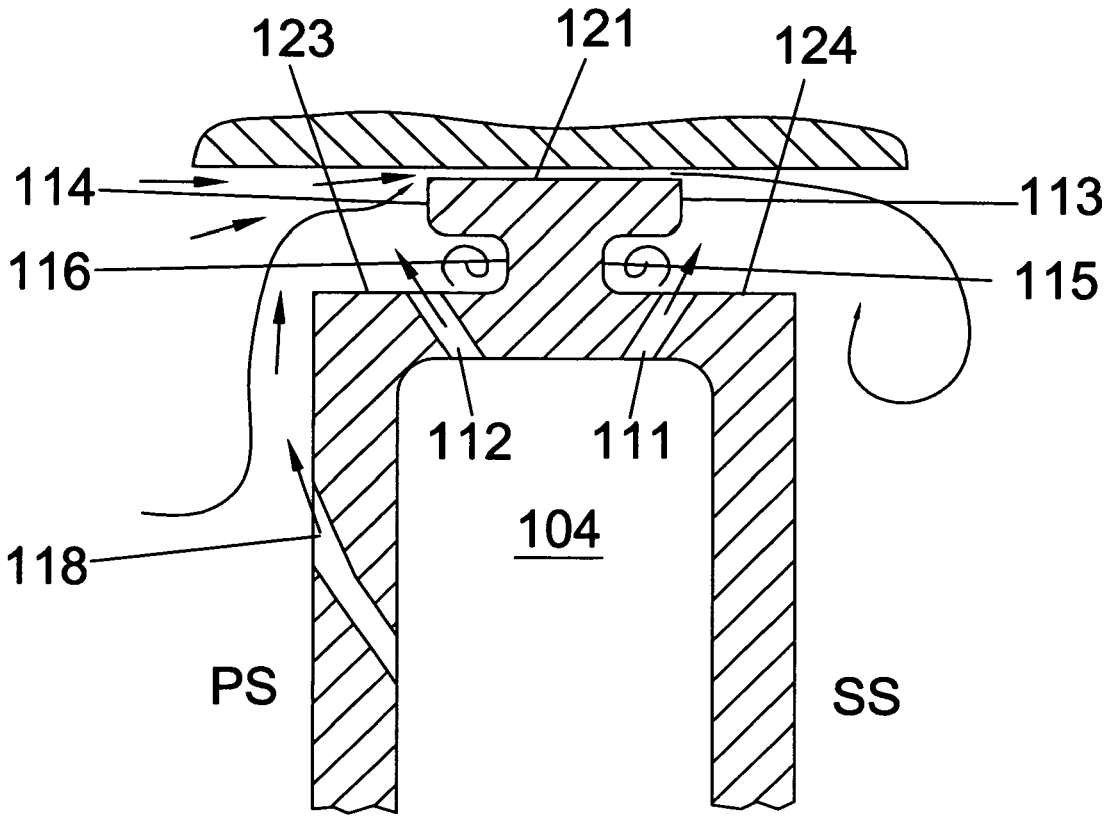
FIG. 5 shows a rear view of a section from FIG. 4 showing the squealer tip configuration of the present invention.

FIG. 5 shows an end view of a section through the trailing edge tip rail of FIG. 4 which shows more clearly the shape of the tip rail with the vortex pockets. The top 121 of the tip rail is shown forming a gap between the BOAS. The pressure side surface 114 and suction side surface 113 of the tip rail are shown in FIG. 5, with the vortex pockets having the sides 116 and 115 clearly shown. Two of the tip cooling holes from the cooling channel 104, one 112 opening onto the pressure side and another 111 opening onto the suction side of the tip rail, supply cooling air to a location outside of the two squealer pockets. The tip cooling holes 112 on the pressure side open onto the trailing edge cap surface 123 on the pressure side of the tip rail 121, and tip cooling holes 111 on the suction side open onto a trailing edge cap surface 124 on the suction side of the tip rail 121. Film cooling holes 118 on the pressure side wall of the blade supply cooling air to push the hot gas flow upward as shown in FIG. 5. Both tip cooling holes 112 and 111 are angled away from the tip rail and vortex pockets as shown in FIG. 5.

In operation, because of the pressure gradient across the airfoil from the pressure side to the suction side, the secondary flow near the pressure side surface migrates from the lower blade span upward across the blade tip. On the pressure side corner of the airfoil location, the secondary leakage flow entering the squealer pocket acts like a developing flow at a low heat transfer rate. This leakage flow is then pushed upward by the pressure side film cooling flow when it enters the squealer tip channel. The pressure side cooling flow on the airfoil pressure side wall or on top of the pressure side tip pocket will push the near wall secondary leakage flow outward and against the oncoming stream-wise leakage flow. This counter flow action reduces the oncoming leakage flow as well as pushes the leakage flow outward to the blade outer air seal (BOAS). In addition to the counter flow action, the vortex convection cooling pocket at the pressure side of the tip rail, forming a cooling recirculation pocket by the tip rail, also forces the secondary flow to bend outward and therefore yields a smaller vena contractor and subsequently it reduces the effectiveness of the leakage flow area. The end result for this combination of effects is to reduce the blade leakage flow that occurs at the blade tip location.

As the leakage flows through the blade end tip to the airfoil suction wall, it creates a flow recirculation with the leakage flow. On the suction side of the airfoil, angled cooling holes on the top of the suction side tip pocket will push the secondary leakage flow outward and against the on-coming leakage flow towards the blade outer air seal. As a result of the injected tip cooling flow and the airfoil suction wall leakage vortex flow interaction, recirculation of cooling air within the vortex cooling pockets is formed which provide cooling for the trailing edge single tip rail. Since the trailing edge single tip rail is located off-set from the airfoil suction wall, the tip rail is also cooled by the through wall conduction of heat load into the convection cooling channel below.

The creation of the leakage flow resistance phenomena by the single centerline vortex cooled blade end tip geometry and cooling flow injection yields a very high resistance for the leakage flow path and therefore reduces the blade leakage flow and heat load. As a result, it reduces the blade tip section cooling flow requirement.

The advantages of the present invention sealing and cooling squealer tip rail design are described below. The blade end tip geometry and cooling air injection induces a very effective blade cooling and sealing for both pressure and suction walls. The single centerline trailing edge tip sealing rail with built-in vortex pockets performs like a double rail sealing for the blade end tip region. The single blade end tip rail geometry with angled radial convective cooling holes along the trailing edge centerline forming a vortex cooling pocket creates a cooling vortex and traps the cooling flow longer, and therefore provides a better cooling for the blade end tip rail. Lower blade tip section cooling demand is due to lower blade leakage flow. Higher turbine efficiency is due to the low blade leakage flow. Reduction of the blade tip section heat load due to low leakage flow increases blade usage life. The centerline blade end tip sealing rail configuration enhances the blade trailing edge tip section. It contains higher convective cooling area than the conventional design. In addition, it also enhances conduction downward to the cooling channel beneath the squealer pocket floor. The combined effect reduces the tip rail; metal temperature as well as thermal gradient through the squealer tip, and therefore reduces thermally induced stress and prolongs the blade useful life.

Figure 6:
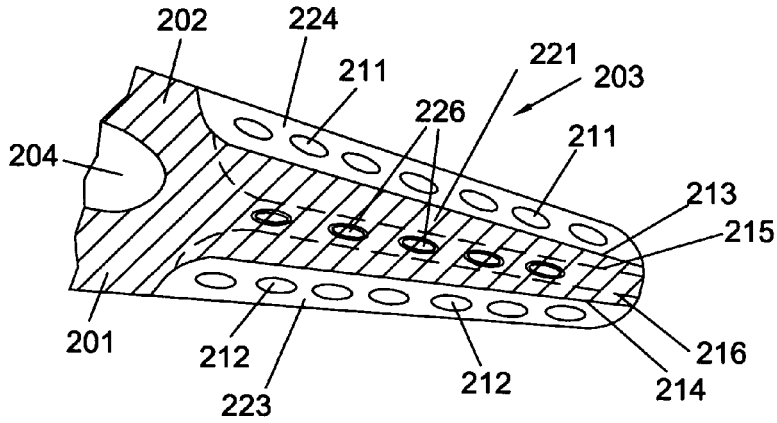
FIG. 6 shows a top view of a second embodiment of the trailing edge region of the present invention.
Figure 7:
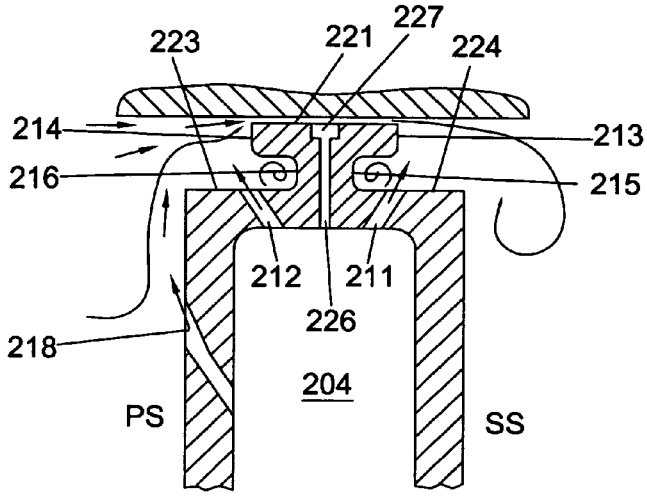
FIG. 7 shows a rear view of a section of the blade of the second embodiment of the present invention.
Figure 8:
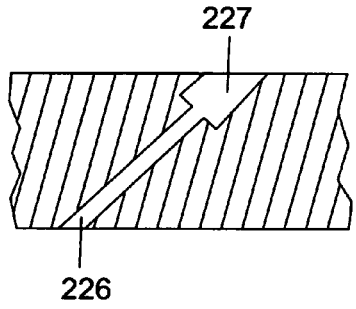
FIG. 8 shows a side view of the rail tip of the second embodiment of the present invention from FIG. 7.

A second embodiment of the present invention is shown with respect to FIGS. 6 through 8. In the second embodiment, convective cooling holes 226 are added along the trailing edge tip rail 221 to provide convective cooling. The cooling holes 226 each open into a diffuser 227 on the surface of the tip rail 221. FIG. 7 shows the cooling holes 226 also connected to the cooling supply channel 204 within the blade. The cooling holes 226 are basically centered along the tip rail 221, and are slanted toward the trailing edge of the blade as shown in FIG. 8.

I claim the following:

1. A turbine rotor blade for use in a gas turbine engine, the blade comprising:

an airfoil section having a leading edge and a trailing edge with a pressure side wall and a suction side wall extending between the two edges;

a blade tip rail having a pressure side wall and a suction side wall;

the pressure side tip rail and the suction side tip rail merging into the trailing edge tip rail;

a first vortex pocket formed on the pressure side tip rail; and, a first row of pressure side tip cooling holes connected to a cooling air supply channel formed within the airfoil and opening onto a trailing edge cap surface on the pressure side and aligned to discharge cooling air to form a vortex flow within the first vortex pocket and to push a hot gas leakage flow up over the trailing edge tip rail; and, a second vortex pocket formed on the suction side tip rail; and, a second row of suction side tip cooling holes connected to the cooling air supply channel formed within the airfoil and opening onto a trailing edge cap surface on the suction side and aligned to discharge cooling air to form a second vortex flow within the second vortex pocket and to push a hot gas leakage flow up over a suction side tip corner.

2. The turbine rotor blade of claim 1, and further comprising:

The first row of pressure side tip cooling holes slants in a direction toward a pressure side tip corner.

3. The turbine rotor blade of claim 1, and further comprising:

the second row of suction side tip cooling holes slants in a direction toward a suction side tip corner.

4. The turbine rotor blade of claim 1, and further comprising:

the trailing edge tip rail extends along a centerline of the blade tip.

5. The turbine rotor blade of claim 1, and further comprising:

the first vortex pocket extends along a length of the trailing edge tip rail.

6. The turbine rotor blade of claim 1, and further comprising:

a third row of tip cooling holes connected to the cooling air supply channel and opening onto a top surface of the trailing edge tip rail.

7. The turbine rotor blade of claim 6, and further comprising:

the third row of tip cooling holes each opens into a diffuser that opens onto the top surface of the trailing edge tip rail.

8. The turbine rotor blade of claim 6, and further comprising:

the third row of tip cooling holes is slanted toward the trailing edge of the blade.

* * * * *